US010276339B2

(12) United States Patent
Nakazato et al.

(10) Patent No.: US 10,276,339 B2
(45) Date of Patent: Apr. 30, 2019

(54) ELECTRON GUN, ELECTRON TUBE AND HIGH-FREQUENCY CIRCUIT SYSTEM

(71) Applicant: NEC NETWORK AND SENSOR SYSTEMS, LTD., Tokyo (JP)

(72) Inventors: Yukihira Nakazato, Tokyo (JP); Eiji Fujiwara, Tokyo (JP)

(73) Assignee: NEC NETWORK AND SENSOR SYSTEMS, LTD., Fuchu-shi, Tokyo (JP)

( * ) Notice: Subject to any disclaimer, the term of this patent is extended or adjusted under 35 U.S.C. 154(b) by 0 days.

(21) Appl. No.: 15/762,874

(22) PCT Filed: Sep. 16, 2016

(86) PCT No.: PCT/JP2016/004241
§ 371 (c)(1),
(2) Date: Mar. 23, 2018

(87) PCT Pub. No.: WO2017/051528
PCT Pub. Date: Mar. 30, 2017

(65) Prior Publication Data

US 2018/0286622 A1 Oct. 4, 2018

(30) Foreign Application Priority Data

Sep. 24, 2015 (JP) ..... 2015-186732

(51) Int. Cl.
*H01J 23/02* (2006.01)
*H01J 23/08* (2006.01)
(Continued)

(52) U.S. Cl.
CPC ..... *H01J 23/34* (2013.01); *H01J 23/027* (2013.01); *H01J 23/04* (2013.01); *H01J 23/06* (2013.01); *H01J 23/065* (2013.01); *H01J 23/087* (2013.01)

(58) Field of Classification Search
CPC ..... H01J 25/34; H01J 23/027; H01J 23/04; H01J 23/065; H01J 19/16; H01J 1/13;
(Continued)

(56) References Cited

U.S. PATENT DOCUMENTS 6,365,897 B1 4/2002 Hamashima et al.
6,456,009 B1 9/2002 Wright et al.
(Continued)

FOREIGN PATENT DOCUMENTS

JP 50-41406 U 4/1975
JP 57-34954 U 2/1982
(Continued)

OTHER PUBLICATIONS

International Search Report for PCT/JP2016/004241, dated Dec. 20, 2016 (PCT/ISA/210).
(Continued)

*Primary Examiner* — Vibol Tan
(74) *Attorney, Agent, or Firm* — Sughrue Mion, PLLC

(57) ABSTRACT

The purpose is to make it possible to autonomously suppress a reduction in an electron beam without providing a means for supervising the electron beam intensity of a monitor or the like. An electron gun, provided with: a heater (12) in which one terminal serves as a heater terminal (H) and the other terminal serves as a shared terminal (HK), and in which a low-voltage power supply (21) is connected between the terminals, the heater (12) generating heat due to a current being supplied from the low-voltage power supply (21); and a cathode electrode (11) connected to the shared terminal (HK) and heated by the heater (12) to discharge thermal electrons. A cathode current (Ik) due to the thermal electrons discharged from the cathode electrode (11), and a current (Ih) due to the low-voltage power supply, flow in opposite directions through the heater (12).

5 Claims, 3 Drawing Sheets

(51) Int. Cl.

| | |
|---|---|
| ***H01J 23/04*** | (2006.01) |
| ***H01J 23/34*** | (2006.01) |
| ***H01J 23/065*** | (2006.01) |
| ***H01J 23/087*** | (2006.01) |
| ***H01J 23/027*** | (2006.01) |
| ***H01J 23/06*** | (2006.01) |

(58) Field of Classification Search
CPC ..... H01J 23/06; H01J 23/26; H01J 25/025; H01J 25/42; H01J 37/304; H01J 23/34; G01K 1/12; H03B 9/08; H05H 2007/084
See application file for complete search history.

(56) References Cited

U.S. PATENT DOCUMENTS

| | | | | |
|---|---|---|---|---|
| 7,315,134 | B2 * | 1/2008 | Matsuoka | H02M 1/36 315/209 R |
| 7,489,084 | B2 * | 2/2009 | Kobayashi | H01J 23/34 315/3.5 |
| 7,800,311 | B2 * | 9/2010 | Chiba | H01J 19/16 315/106 |
| 7,952,288 | B2 * | 5/2011 | Nakazato | H01J 23/34 315/3.5 |
| 8,027,182 | B2 * | 9/2011 | Abiko | G01R 19/0092 363/120 |
| 8,212,481 | B2 * | 7/2012 | Nakazato | H01J 25/34 315/3 |
| 8,491,187 | B2 * | 7/2013 | Nakazato | G01K 1/08 361/37 |
| 8,905,634 | B2 * | 12/2014 | Nakazato | G01K 1/08 361/37 |
| 8,981,799 | B2 * | 3/2015 | Nakazato | G01R 19/0092 324/123 R |
| 9,196,448 | B2 * | 11/2015 | Kasahara | H01J 25/34 |
| 10,062,538 | B2 * | 8/2018 | Aditya | H01J 23/26 |
| 10,068,738 | B2 * | 9/2018 | Munehiro | H01J 23/34 |
| 2005/0099140 | A1 * | 5/2005 | Matsuoka | H02M 1/36 315/224 |
| 2009/0237041 | A1 | 9/2009 | Abiko | |
| 2014/0292190 | A1 * | 10/2014 | Kasahara | H01J 23/26 315/3.5 |
| 2017/0140892 | A1 * | 5/2017 | Munehiro | H01J 23/34 |

FOREIGN PATENT DOCUMENTS

| | | | |
|---|---|---|---|
| JP | 8-171879 | A | 7/1996 |
| JP | 11-242943 | A | 9/1999 |
| JP | 2004-159266 | A | 6/2004 |
| JP | 5099636 | B2 | 12/2012 |

OTHER PUBLICATIONS

Written Opinion of the International Searching Authority for PCT/JP2016/004241 (PCT/ISA/237), dated Dec. 20, 2016.

* cited by examiner

ELECTRON GUN, ELECTRON TUBE AND HIGH-FREQUENCY CIRCUIT SYSTEM

CROSS REFERENCE TO RELATED APPLICATIONS

This application is a National Stage of International Application No. PCT/JP2016/004241 filed Sep. 16, 2016, claiming priority based on Japanese Patent Application No. 2015-186732, filed Sep. 24, 2015

TECHNICAL FIELD

The present invention relates to an electron gun, an electron tube and a high-frequency circuit system that generate an electron beam by voltage driving.

BACKGROUND ART

A traveling wave tube, a klystron or the like are electron tubes to be used for performing amplification, oscillation or the like of a high-frequency signal by interaction between an electron beam formed by an electron gun and a high-frequency circuit.

In Patent Literature 1 (PTL1), there is disclosed a traveling wave tube 100 as illustrated in FIG. 3. The traveling wave tube 100 includes an electron gun 102 that forms an electron beam 101, a helix electrode 105, which is a high-frequency circuit that makes the electron beam 101 formed by the electron gun 102 and a high-frequency signal (microwave) interact with each other, and a collector electrode 106 that collects the electron beam 101 outputted from the helix electrode 105 (Referring to PTL1).

The electron gun 102 includes a cathode electrode 103 that forms thermal electrons, and a heater 104 that supplies heat energy for forming thermal electrons to the cathode electrode 103.

The electron beam 101 formed by the electron gun 102 is accelerated by an electric potential difference between the cathode electrode 103 and the helix electrode 105, and is introduced into the helix electrode 105. Then, the electron beam 101 proceeds through the inside of the helix electrode 105 while interacting with high-frequency signals inputted from an end of the helix electrode 105. The electron beam 101 that has passed through the inside of the helix electrode 105 is collected by the collector electrode 106.

A power supply device includes: a helix power supply 107 that supplies to the cathode electrode 103 a helix voltage (Ehel), which is a negative direct-current voltage on the basis of the electric potential (HELIX) of the helix electrode 105; a collector power supply 108 that supplies to the collector electrode 106 a collector voltage (Ecol), which is a positive direct-current voltage on the basis of the electric potential (H/K) of the cathode electrode 103; and a heater power supply 109 that supplies to the heater 104 a heater voltage (Eh), which is a negative direct-current voltage on the basis of the electric potential (H/K) of the cathode electrode 103.

In the electron gun of such structure, it is made such that thermal electrons are formed easily from the cathode electrode 103 by heating the cathode electrode 103 by the heater 104.

However, there is an issue that an amount of formed electrons decreases (that is, an amount of electron beams decreases) due to long-term deterioration of a cathode electrode by long term use even if a heater current, a helix voltage value, a collector voltage value or the like are driven on the same conditions.

About such issue, there is proposed in Patent Literature 2 (PTL2) a technology in which an amount of formed electrons is monitored, and the cathode temperature is made to rise by increasing a heater current based on a monitoring result, thereby compensating decrease in the amount of formed electrons. Patent literature 3 (PTL3) relates to setting of an operating temperature of a Shottkey emission electron gun. In PTL 3, there is disclosed that an operating temperature is determined in such a way that a Shottkey emission electron current set in advance is obtained at a predetermined extraction voltage. In addition, in PTL3, there is proposed that a Shottkey emission chip of an electron gun is heated for a short time to the above-mentioned operating temperature or more in order to improve cleanliness of the Shottkey emission chip.

CITATION LIST

Patent Literature

[PTL1] Japanese Patent No. 5099636

[PTL2] U.S. Pat. No. 6,456,009

[PTL3] Japanese Patent Application Laid-Open No. Hei 8-171879

SUMMARY OF INVENTION

Technical Problem

However, in a structure according to PTL2, there are needed a monitoring means of an amount of formed electrons and a control means for adjusting a heater current based on a monitoring result. For this reason, control becomes complicated and a circuit size becomes large, which is a factor of increase in a device cost.

Accordingly, a main object of the present invention aims at providing an electron gun, an electron tube and a high-frequency circuit system which autonomously compensate an amount of electron beams of such as a monitor or the like without including a means for monitoring an electron beam amount.

Solution to Problem

To resolve the above-mentioned issue, an electron gun according to the present invention includes:

a heater, including one terminal as a heater terminal and another terminal as a shared terminal, to generate heat by current supply from a low-voltage power supply being connected between the terminals; and a cathode electrode, connected to the shared terminal, to form thermal electrons by being heated by the heater; wherein a cathode current generated by thermal electrons formed by the cathode electrode and a current generated by the low-voltage power supply flow through the heater in opposite directions.

In addition, an invention according to an electron tube includes:

a heater, including one terminal as a heater terminal and another terminal as a shared terminal, to generate heat by current supplied from a low-voltage power supply being connected between the terminals;

a cathode electrode, connected to the shared terminal, to form thermal electrons by being heated by the heater; and a collector electrode that is an opposite electrode to the cathode electrode, wherein a high-voltage power supply is connected between the cathode electrode and the collector electrode, thermal electrons formed by the cathode electrode due to an electric field by the high-voltage power supply are collected by the collector electrode to make a cathode current flow via the heater, and the cathode current flows in a reverse direction to an electric current by the low-voltage power supply.

Advantageous Effect of Invention

According to the present invention, decrease in an electron beam amount due to deterioration of heat electron emission characteristics in a cathode electrode is compensated autonomously by making a low-voltage current and a cathode current that flow through a heater flow in opposite directions, and thus it becomes possible to provide an electron gun and electron tube that are highly reliable using a low-cost and simple structure.

DESCRIPTION OF EMBODIMENTS

Figure 1:
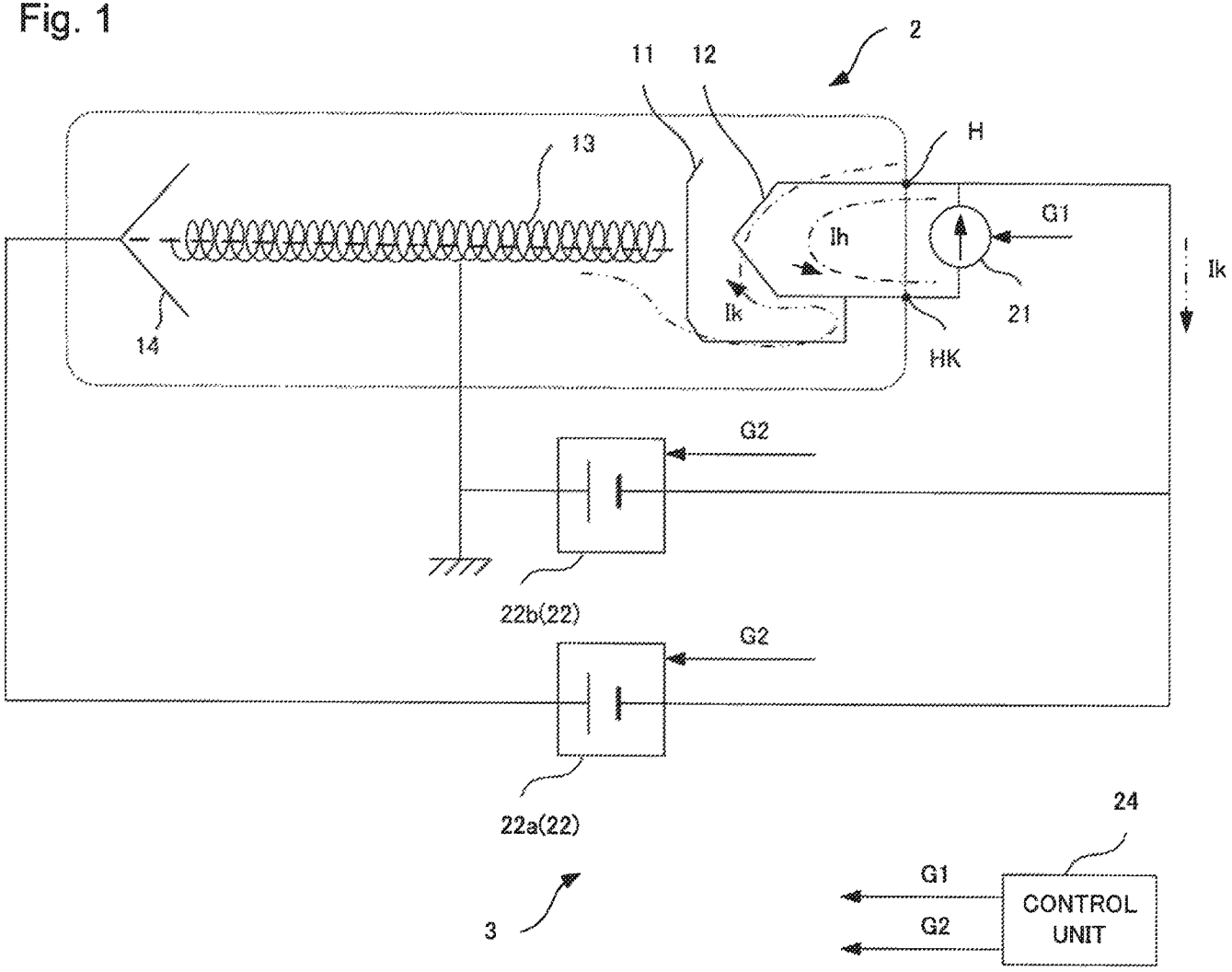
FIG. 1 is a block diagram of an electron tube according to a present example embodiment.

An example embodiment of the present invention will be described. FIG. 1 is a block diagram of a high-frequency circuit system 3 including an electron tube 2 according to the present embodiment. The high-frequency circuit system 3 includes the electron tube 2 and a power supply to supply electric power to the electron tube 2, and, for example, there are illustrated a high power amplifier (HPA) that amplifies a microwave in order to transmit information such as images, data, sound and the like in satellite communication, ground microwave communication or the like, a microwave power module (MPM) that is a modularized version of HPA or the like.

The electron tube 2 includes a cathode electrode 11, a heater 12, a helix electrode 13 and a collector electrode 14. Note that the cathode electrode 11 and the heater 12 constitute an electron gun. The cathode electrode 11 and the heater 12 are connected to each other inside the electron tube 2. In FIG. 1, a connection point is indicated by a reference symbol HK.

The electron tube 2 is driven in a controlled manner by a control driving means composed of a low-voltage power supply 21, a high-voltage power supply 22, and a control unit 24. Further, the high-voltage power supply 22 includes a collector power supply 22*a* and a helix power supply 22*b*. Note that the power supply of the high-frequency circuit system 3 is also the power supply for the above-mentioned electron tube 2.

The low-voltage power supply 21 is connected to a heater terminal H and a heater terminal HK, and supplies electric current to the heater 12. Further, the heater terminal HK is also connected to the cathode electrode 11, and thus the heater terminal HK is hereinafter described as a shared terminal HK.

The low-voltage power supply 21 is a constant current power supply, and, when a heating signal G1 is received from the control unit 24, outputs an electric current of a numerical value set in advance. Hereinafter, an electric current to be outputted from the low-voltage power supply 21 is described as the low-voltage current Ih. The low-voltage current Ih flows through a circuit composed of the heater terminal H, the heater 12 and the shared terminal HK. Further, in the following description, an electric current which actually flows through the heater 12 is defined as the heater current If. This is because the low-voltage current Ih and the heater current If are not identical necessarily.

The collector power supply 22*a* included in the high-voltage power supply 22 is a power supply for drawing out electrons formed by the cathode electrode 11 to make the formed electrons be an electron beam. The helix power supply 22*b* is a power supply for accelerating thermally formed electrons to generate a microwave.

The collector power supply 22*a* is connected between the collector electrode 14 and the heater terminal H. The helix power supply 22*b* is connected between the helix electrode 13 and the heater terminal H.

By such connection relationship, electrons formed by the cathode electrode 11 are accelerated by the electric potential difference between the cathode electrode 11 and helix electrode 13, and are collected by the collector electrode 14. An electric current at that time is an electron beam, and also is the cathode current Ik.

That is, the cathode current Ik flows through a circuit composed of the heater terminal H, the heater 12, the cathode electrode 11, the collector electrode 14, the collector power supply 22*a* and the heater terminal H. Accordingly, the heater current If that flows through the heater 12 will be expressed as follows:

$$If = Ih + Ik \tag{1}$$

In Formula 1, Ih is a low-voltage current and Ik is a cathode current. Then, although the low-voltage current Ih and the cathode current Ik flow through the heater 12 together, the current directions of these are reverse directions to each other. Accordingly, considering the current directions, Formula 1 can be written as follows:

$$If = Ih - Ik \tag{2}$$

This means that, when the cathode current Ik flows, the heater current If becomes smaller than the low-voltage current Ih.

Figure 2:
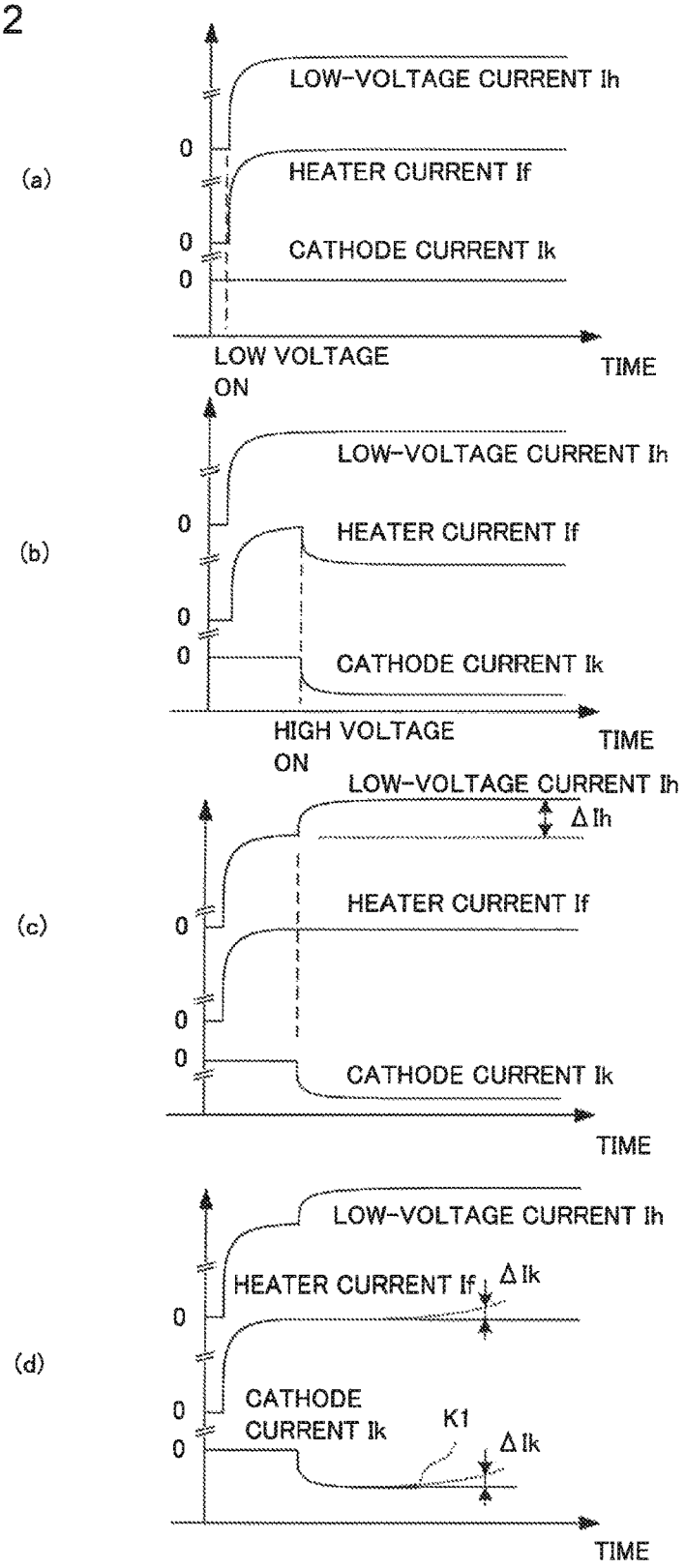
FIG. 2 is a diagram illustrating time changes of a low-voltage current, a heater current and a cathode current, and (a) is a diagram describing a case when Ik=0, (b) is a diagram when making a cathode current Ik flow, (c) is a diagram when adjusting a low-voltage current Ih, and (d) is a diagram illustrating a self-compensation operation of a heater current If.
Figure 3:
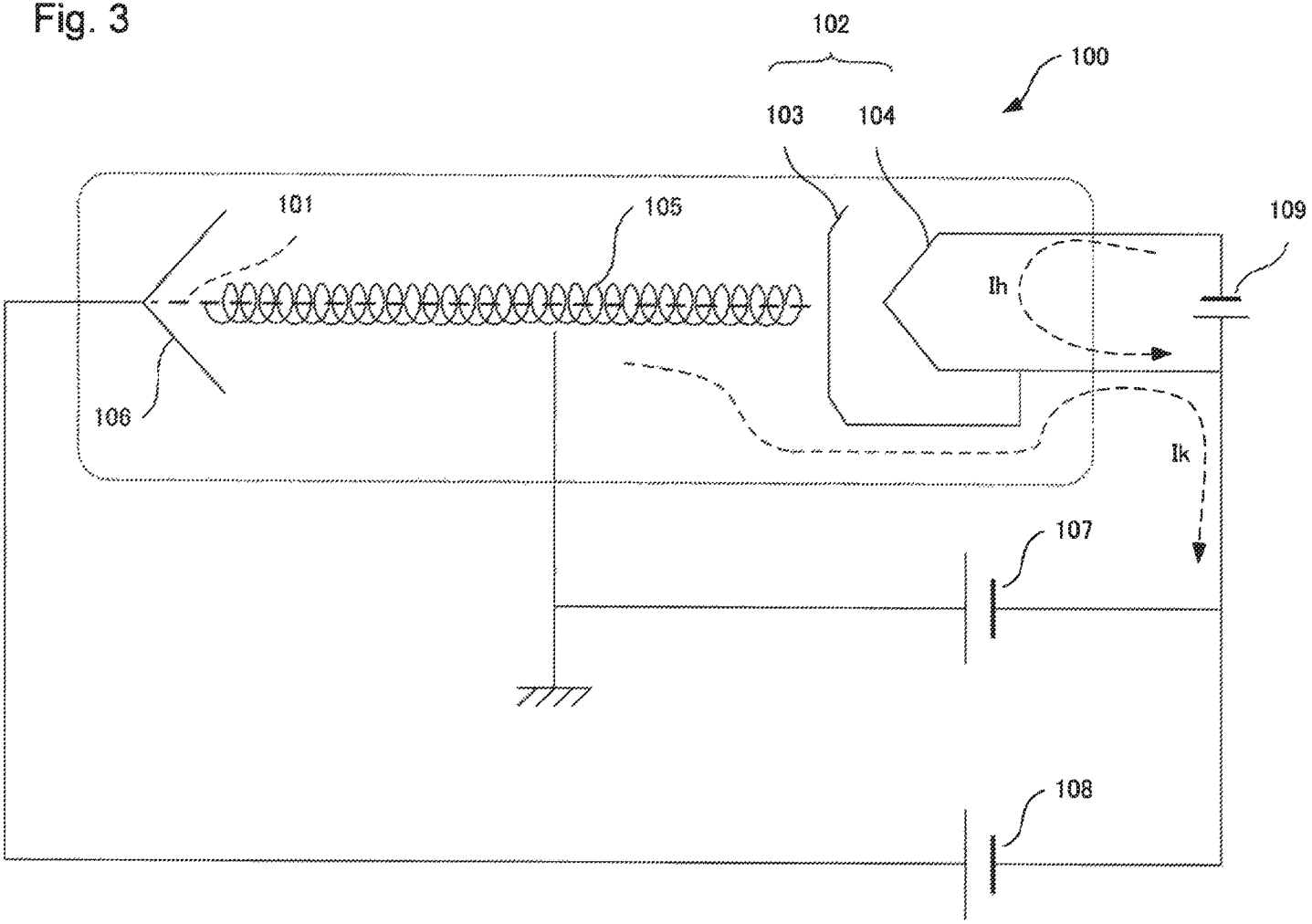
FIG. 3 is a block diagram of an electron tube to be applied to illustration of the related technology.

Next, such control driving of electron tube 2 will be described. FIG. 2 is a diagram illustrating time changes of the low-voltage current Ih, the heater current If and the cathode current Ik, and FIG. 2(*a*) is a diagram indicating a case when Ik=0, FIG. 2 (*b*) is a diagram when making the cathode current Ik flow, FIG. 2(*c*) is a diagram when adjusting the low-voltage current Ih, and FIG. 2(*d*) is a diagram illustrating the self-compensation operation of the heater current If.

First, the control unit 24 outputs the heating signal G1 that directs to apply the low-voltage current Ih to the low-voltage power supply 21 (Referring to FIG. 2(*a*)). In FIG. 2(*a*), "Low voltage ON" indicates the timing at which the low-voltage power supply 21 is driven and the heater 12 is begun to be energized. The heater current If will be the same numerical value as the low-voltage current Ih (If=Ih) because the low-voltage current Ih is supplied to the heater 12 and, in addition, an extraction signal G2 has not been outputted yet to the high-voltage power supply 22 at that time (Ik=0).

The heater 12 generates heat by the low-voltage current Ih, and the temperature of the cathode electrode 11 rises and thermal electrons are formed. Then, at the time when the cathode electrode 11 reaches a fixed temperature, the control unit 24 outputs the extraction signal G2 to the high-voltage power supply 22. In FIG. 2(*b*), "High voltage ON" indicates the operation timing of the high-voltage power supply 22. As a result, voltage is applied between the helix electrode 13 and the heater 12, and between the collector electrode 14 and the heater 12, and the cathode current Ik flows.

Alternately, it is possible to perform control in such a way that, when a time set in advance has passed after the control unit 24 has outputted the heating signal G1, it is assumed that the cathode electrode 11 has reached a fixed temperature. In this way, temperature monitoring of the cathode electrode 11 is unnecessary, and thus there is an advantage that the circuit configuration of the control unit 24 becomes simple.

Since the cathode current Ik and the low-voltage current Ih at that time are electric currents in opposite directions, the low-voltage current Ih is of a smaller value than the heater current If by the cathode current Ik (Referring to Formula 2). This means that the cathode current Ik functions as an operation margin to a rated current of the heater 12 because, even if the low-voltage power supply 21 is outputting the rated current, only a heater current smaller than the rated current by the cathode current Ik flows through the heater 12.

Although such operation margin can be used as an operation margin, there may be cases where it is not necessary to consider an operation margin so much since the low-voltage power supply 21 is a constant current power supply and the heater 12 is a current active element.

In such cases, it is also possible to increase the low-voltage current Ih (Referring to FIG. 2(*c*)). In FIG. 2(*c*), the low-voltage current Ih is increased by ΔIh (=Ik) corresponding to the operation margin at the timing of High voltage ON. Further, timing when the low-voltage current Ih is increased may be any time after the turning on of the high voltage.

It is supposed that, in a case where operation is continued in such state, an amount of the thermal electrons formed by the cathode electrode 11 is decreased due to deterioration of the characteristics of the cathode electrode 11. The dotted line K1 in FIG. 2(*d*) indicates decrease in the cathode current Ik due to deterioration of the heat electron emission characteristics. Here, let a deterioration amount of the cathode current Ik be ΔIk. At that time, the heater current If becomes as follows:

$$\begin{aligned} If &= Ih - (Ik - \Delta Ik) \\ &= Ih - Ik + \Delta Ik \end{aligned} \tag{3}$$

In other words, when the emission amount of thermal electrons decreases due to characteristics deterioration of the cathode electrode 11, the heater current If increases by ΔIk and a heat generation amount by the heater 12 increases. As a result, the temperature of the cathode electrode 11 rises, and decrease in a heat electron emission amount is compensated autonomously.

As it has been described above, decrease in an electron beam amount due to deterioration of heat electron emission characteristics in a cathode electrode is compensated autonomously by making a low-voltage current and a cathode current which flow through a heater flow in opposite directions, and, therefore, a highly reliable electron gun and electron tube can be provided using a low-cost and simple structure.

As above, the present invention has been described taking the example embodiment mentioned above as an exemplary example. However, the present invention is not limited to the example embodiment mentioned above. In other words, various aspects which a person skilled in the art can understand can be applied to the present invention within the scope of the present invention.

REFERENCE SIGNS LIST

2 Electron tube
3 High-frequency circuit system
11 Cathode electrode
12 Heater
13 Helix electrode
14 Collector electrode
21 Low-voltage power supply
22 High-voltage power supply
22*a* Collector power supply
22*b* Helix power supply
24 Control unit

The invention claimed is:

1. An electron gun comprising:

a heater, including one terminal as a heater terminal and another terminal as a shared terminal, to generate heat by current supply from a low-voltage power supply being connected between the terminals; and a cathode electrode, connected to the shared terminal, to form thermal electrons by being heated by the heater; wherein a cathode current generated by thermal electrons formed by the cathode electrode and a current generated by the low-voltage power supply flow through the heater in opposite directions.

2. An electron tube comprising:

a heater, including one terminal as a heater terminal and another terminal as a shared terminal, to generate heat by current supplied from a heater power supply being connected between the terminals;

a cathode electrode, connected to the shared terminal, to form thermal electrons by being heated by the heater; and a collector electrode that is an opposite electrode to the cathode electrode, wherein a high-voltage power supply is connected between the cathode electrode and the collector electrode, thermal electrons formed by the cathode electrode due to an electric field by the high-voltage power supply are collected by the collector electrode to make a cathode current flow via the heater, and the cathode current flows in a reverse direction to an electric current by the heater power supply.

3. The electron tube according to claim 2, wherein the heater power supply is a constant current power supply.

4. The electron tube according to claim 2, further comprising a control unit that controls the heater power supply in such a way that a predetermined specified current flows through the heater;

controls the high-voltage power supply in such a way that, when the heater reaches a constant temperature due to the specified current, the cathode current flows to the cathode electrode; and controls the heater power supply in such a way that, after the cathode current has flowed, an electric current being supplied from the low-voltage power supply to the heater is increased by a value corresponding to the cathode current.

5. A high-frequency circuit system comprising:

an electron tube according to claim 3; and a power supply to supply electric power to the electron tube.

* * * * *